US008191394B2

(12) United States Patent
Marshall

(10) Patent No.: US 8,191,394 B2
(45) Date of Patent: Jun. 5, 2012

(54) STEP FLASHING BENDING DEVICE

(76) Inventor: Joseph T. Marshall, Rathwell (CA)

( * ) Notice: Subject to any disclaimer, the term of this patent is extended or adjusted under 35 U.S.C. 154(b) by 237 days.

(21) Appl. No.: 12/776,481

(22) Filed: May 10, 2010

(65) Prior Publication Data

US 2010/0300174 A1 Dec. 2, 2010

(30) Foreign Application Priority Data

Jun. 2, 2009 (CA) ..... 2667308

(51) Int. Cl.
*B21D 5/16* (2006.01)

(52) U.S. Cl. ..... 72/319; 72/458

(58) Field of Classification Search ..... 72/319, 72/458, 380, 386, 411
See application file for complete search history.

(56) References Cited

U.S. PATENT DOCUMENTS 3,380,280 A * 4/1968 Wise ..... 72/319
3,817,075 A * 6/1974 Marsh et al. ..... 72/319
3,877,279 A * 4/1975 Van Cleave ..... 72/319
4,493,200 A * 1/1985 Rhoades ..... 72/319
4,557,132 A * 12/1985 Break ..... 72/319
5,209,096 A * 5/1993 Phelps ..... 72/319
6,681,613 B1 1/2004 English
7,549,311 B2 * 6/2009 Break ..... 72/319

* cited by examiner

*Primary Examiner* — Faye Francis

(74) *Attorney, Agent, or Firm* — Ryan W. Dupuis; Kyle R. Satterthwaite; Ade & Company Inc.

(57) ABSTRACT

A step flashing bending device comprises a supporting a lower press block and an upper press block thereon for movement relative to one another for bending blank metal sheets into step flashing therebetween. The press blocks have working surfaces which are elongate in a longitudinal direction extending at a downward inclination from a top end to a bottom end thereof. The frame and the press blocks are open at the bottom end such that the working surfaces are arranged to automatically release the step flashing from the frame between the bottom ends of the upper and lower press blocks under force of gravity when the press blocks are separated into an open position.

15 Claims, 4 Drawing Sheets

STEP FLASHING BENDING DEVICE

This application claims foreign priority benefits from Canadian Patent Application 2,667,308 filed Jun. 2, 2009.

FIELD OF THE INVENTION

The present invention relates to a bending device similar to a press brake and which is suitable for bending blank metal sheets into step flashing of the type generally comprising two flanges bent approximately at right angle to one another.

BACKGROUND

When roofing, it is common to make use of step flashing at an intersection of roofing material and adjacent vertical surfaces extending upwardly from the roof. Typical step flashing comprises two flanges of sheet metal which are joined along a fold line at right angles to one another such that one of the flanges can be received under the roofing material while the other flange can be sealed against the respective upright surface or overlapped by finishing materials on the upright surface.

As described in U.S. Pat. No. 6,681,613 by English, there exists many sheet metal bending tools in the prior art, however none are well suited for specifically forming step flashing from small blanks of sheet metal in a practical and efficient manner which does not occupy manufacturing time on larger bending tools better suited for manufacturing larger bent material.

U.S. Pat. No. 6,681,613 by English describes a chimney flashing fabrication tool which mainly comprises a channel arranged to receive one side edge of a sheet metal blank therein for folding the side edge upwardly to form one of the two flanges of the flashing. The folding requires the user to manually grasp a body of the tool to fold the sheet metal against a supporting surface. While use of the tool does permit larger bending equipment to be used for other purposes, the tool itself requires considerably manual effort on the part of the user to bend the sheet metal, while also requiring an awkward and time consuming manipulation of the tool to align a sheet metal edge with the channel in the tool for each flashing being formed. Accordingly the tool is inefficient for manufacturing large amounts of step flashings.

SUMMARY OF THE INVENTION

According to one aspect of the invention there is provided a step flashing bending device for bending blank metal sheets into step flashing, the device comprising:

a frame;

a lower press block comprising an elongate working surface supported on the frame to extend in a longitudinal direction at a downward inclination from a top end to a bottom end of the lower press block; and an upper press block comprising an elongate working surface supported on the frame to extend in a longitudinal direction at a downward inclination from a top end to a bottom end of the upper press block so as to be substantially parallel to the working surface of the lower press block;

the upper and lower press blocks being supported on the frame for movement relative to one another between an open position in which the working surfaces are spaced apart from one another so as to receive a blank metal sheet therebetween and a working position in which the working surfaces are displaced towards one another relative to the open position;

the working surfaces being suitably shaped such that the blank metal sheet is arranged to be bent into a step flashing in the working position; and the frame comprising a bottom opening between working surfaces of the upper and lower press blocks at the bottom ends thereof such that the working surfaces are arranged to release the step flashing from the frame between the bottom ends of the upper and lower press blocks when the press blocks are displaced into the open position.

By providing upper and lower press blocks having working surfaces arranged to bend sheet metal blanks into step flashing where the working surfaces are at an upward inclination in alignment with an open bottom end of the frame, a suitable linkage can be used to bend the sheet metal with minimal manual effort while the formed flashing automatically drops out of the frame upon formation of the step flashing for quick reloading with another blank. Accordingly a small dedicated step flashing is provided where a user can be reaching for another blank to be loaded into the frame between the working surfaces as a previously inserted blank is bent into step flashing to permit a series of flashings in large numbers to be formed in a very short period of time with minimal effort.

The lower press block is preferably supported in fixed relation to the frame.

The upper press block may be supported at the top and bottom ends on the frame for linear sliding movement relative to the frame in a working direction perpendicular to the longitudinal direction of the working surfaces between the open position and the working position.

There may be provided a lever pivotally coupled on the frame in which the lever is connected through a linkage to the upper press block at a central location between the top and bottom ends of the working surface.

The frame may comprise a pair of side walls supporting the press blocks therebetween. Preferably a side opening is located in each side wall in alignment with the space between the working surfaces in the open position so as to be arranged to receive opposing ends of the blank metal sheets therethrough.

Preferably the side openings are open at respective bottom ends thereof such that the step flashing is arranged to be released from the side openings in the frame through the bottom ends of the side openings.

There may be provided an end wall spanning generally parallel to a plane of one of the side openings of the side walls at a location spaced laterally outwardly from the respective side wall so as to be arranged to abut one side edge of a blank metal sheet inserted between the working surfaces for bending into step flashing. The end wall may be supported on the frame such that a space between the end wall and the respective side wall is adjustable.

When the frame comprises a pair of side walls supporting the press blocks therebetween and a lever is pivotally coupled on one of the side walls of the frame, preferably a linkage is coupled between the lever and at least one of the press blocks to displace the press blocks into the working position when the lever is pivoted.

When there is provided a pivot shaft pivotally supported at opposing ends on the two side walls of the frame, the lever may be arranged to be mounted on the pivot shaft so as to be reversibly mounted adjacent either one of the two side walls of the frame.

Preferably the lever is rotated upwardly over center between the open position and the working position of the press blocks.

The lever may comprise an inner portion adjacent a pivot axis of the lever which extends radially outwardly from the pivot axis and an outer portion which extends outwardly from the inner portion and which is angularly offset from the inner portion in a direction of rotation of the lever from the open position to the working position.

A counter mechanism may be supported on the frame and arranged to count each movement of the upper and lower press blocks between the open and working positions.

The frame may include at least one horizontal mounting flange arranged to be fastened to a generally horizontal supporting surface and at least one vertical mounting flange arranged to be fastened to a generally vertical supporting surface.

The frame may also include a trough portion arranged to support a plurality of stacked step flashings therein. Preferably the trough portion is aligned with the bottom opening in the frame so as to be arranged to receive step flashing which is slidably removed from the press blocks in the longitudinal direction of the working surfaces.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
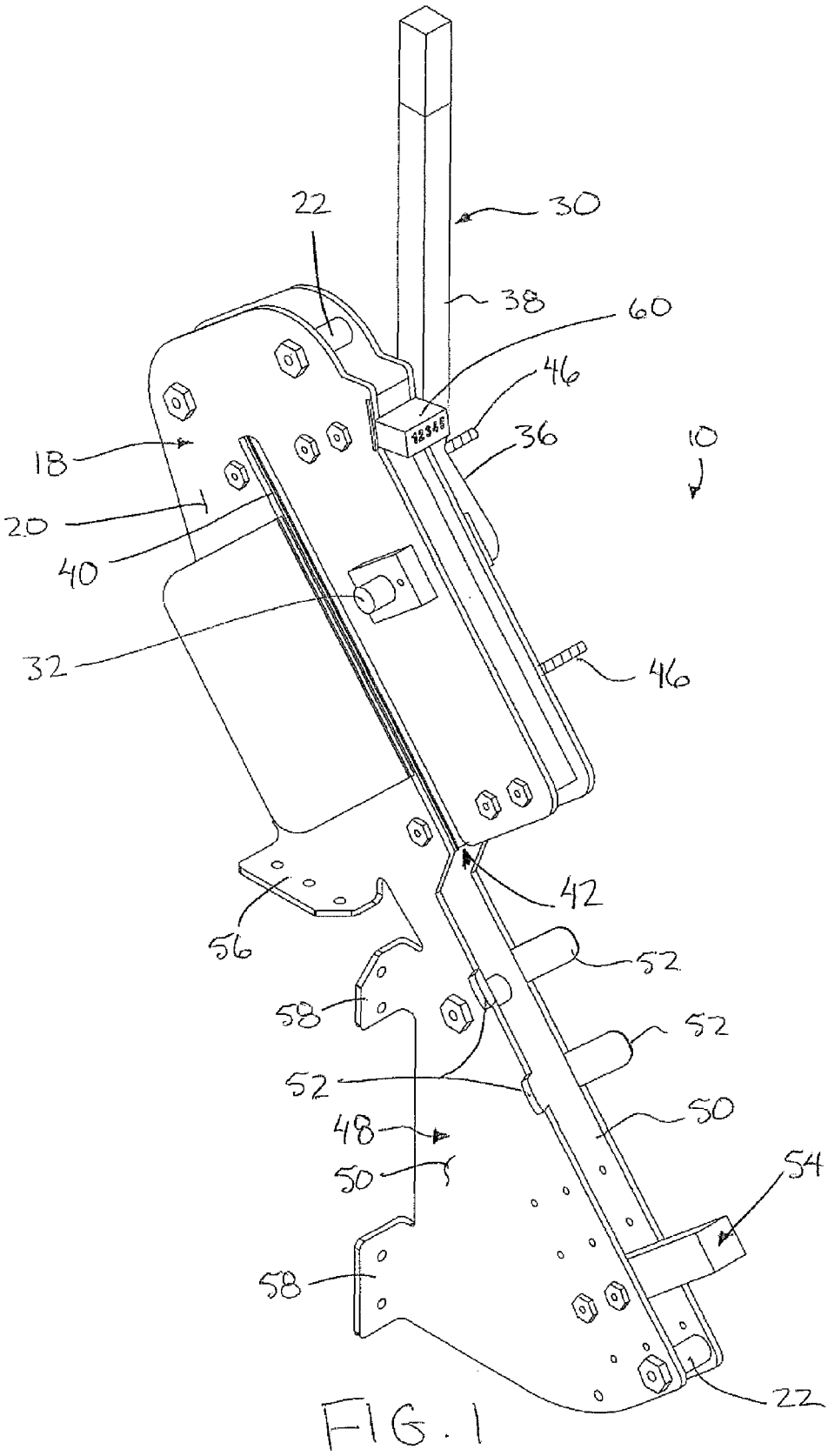
FIG. 1 is a perspective view of a first side of the step flashing bending device.
Figure 2:
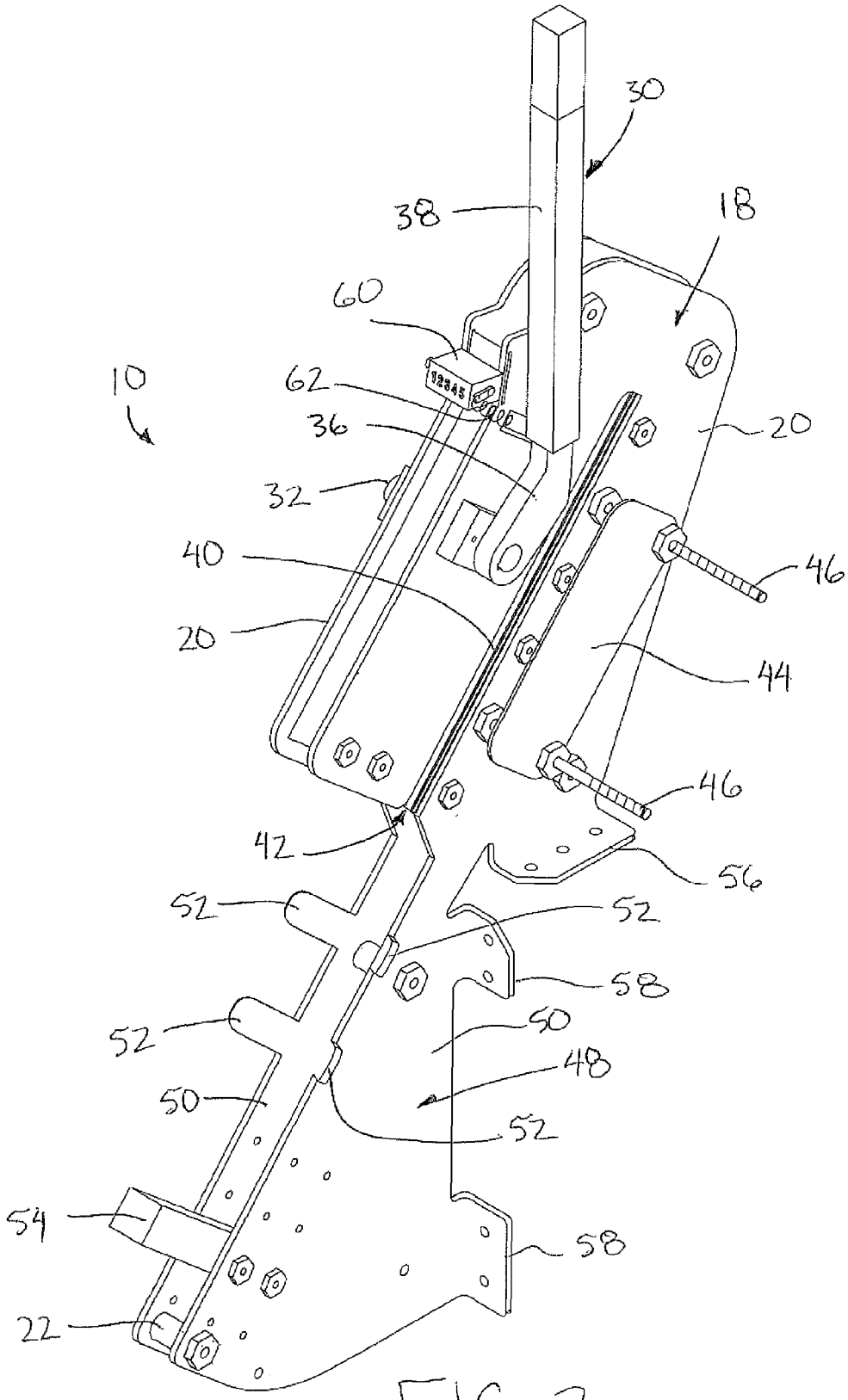
FIG. 2 is perspective view of an opposing side of the device in relation to FIG. 1.
Figure 3:
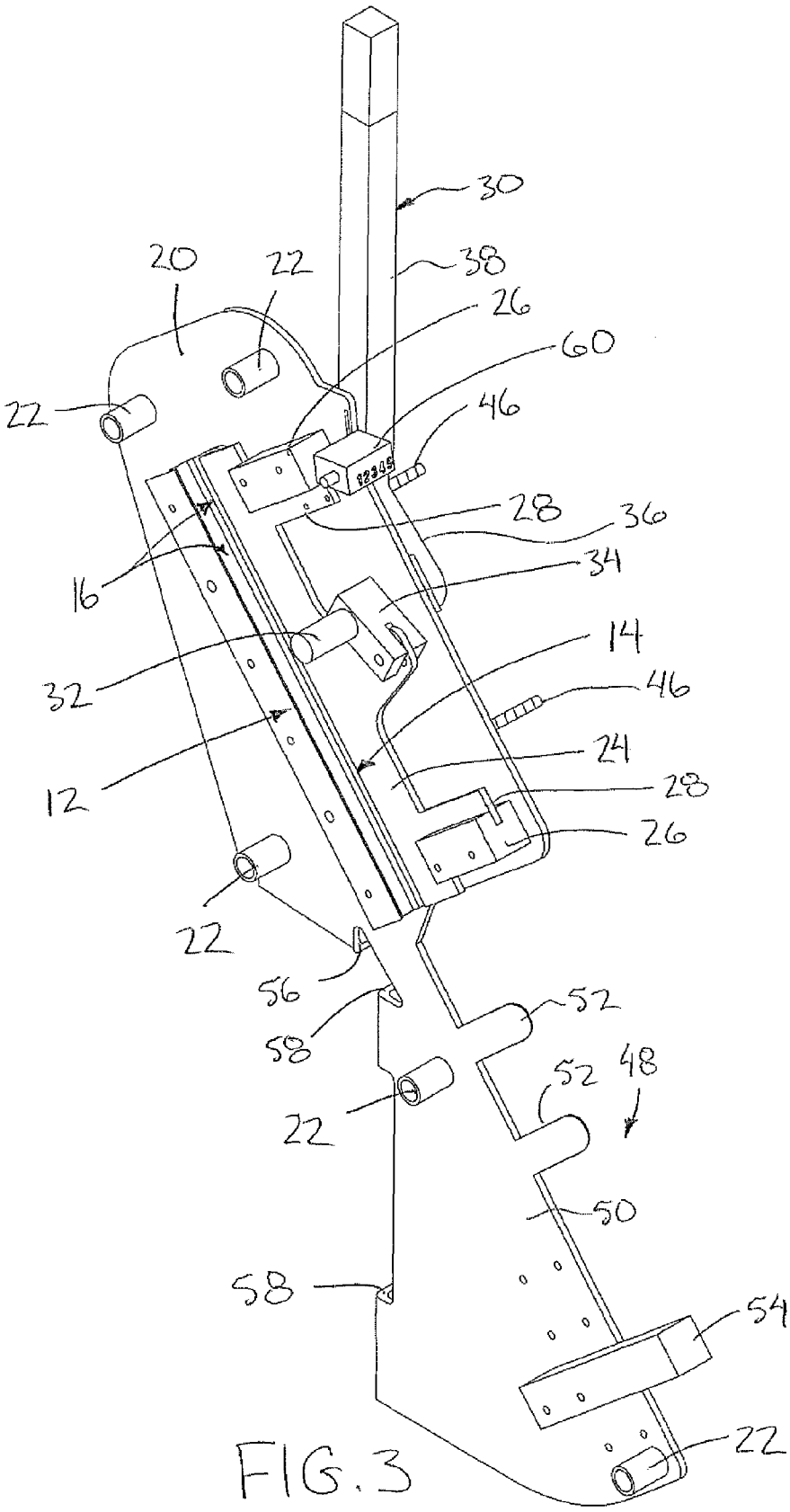
FIG. 3 is a perspective view the device of FIG. 1 with one of the side walls of the frame shown removed.
Figure 4:
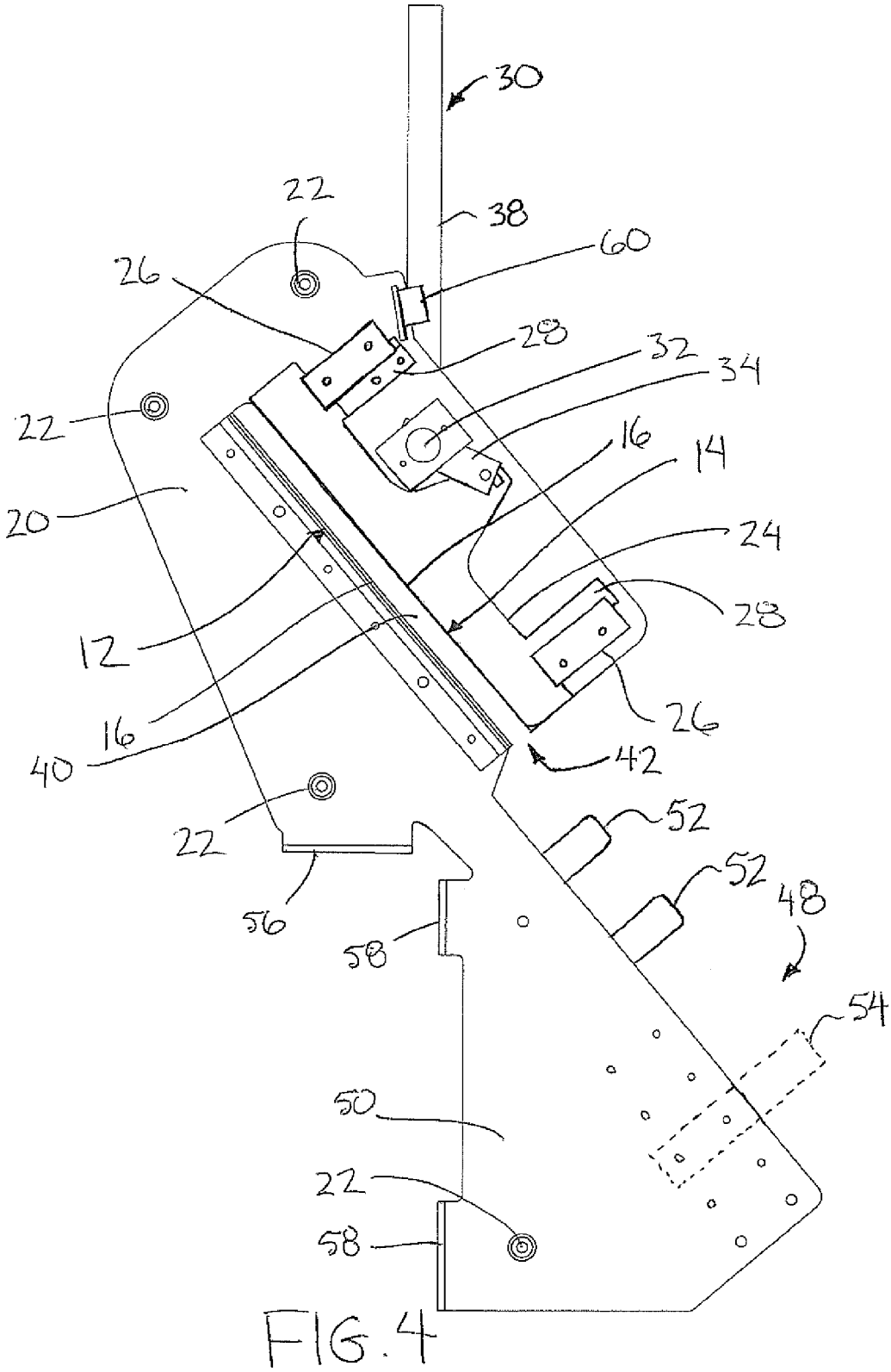
FIG. 4 is a side elevational view of the device of FIG. 1 with one of the side walls of the frame shown removed.

Referring to the accompanying figures there is illustrated a step flashing bending device generally indicated by reference numeral 10. The device 10 is particularly suited for bending blank metal sheets into step flashing.

The device 10 comprises a lower press block 12 and an upper press block 14 which each comprise a working surface 16 which are suitably shaped and arranged to bend a flat blank metal sheet into the two flanges at right angles to one another which define the step flashing when the working surfaces are brought together with the blank metal sheet therebetween from an open position in which the working surfaces are spaced apart to a working position clamping the blank metal sheet therebetween.

The device further comprises a frame 18 having a main portion comprised of two side walls 20 which are supported parallel and spaced apart from one another to receive the upper and lower press block therebetween. A plurality of frame members 22 function as spacers which are fastened to span perpendicularly to the spaced apart side walls at a plurality of spaced apart locations to adequately support the two side walls fixed in relation to one another at a prescribed spacing which closely receives the press blocks therebetween.

The lower press block 12 is supported in fixed relation between the two side walls of the main portion of the frame such that the working surface thereof is oriented to be elongate in a longitudinal direction at a downward inclination from a top end to a bottom end of the working surface. The working surface in this instance is generally trough shaped comprising two elongate edges joined by a generally U-shaped recess spanning therebetween along the length of the working surface in the longitudinal direction.

The upper press block 14 is supported on a suitable carrier body 24 which is in turn supported on a pair of guides 26 for linear sliding movement towards and away from the lower press block in a working direction which is perpendicular to the longitudinal direction of the lower press block.

The upper press block 14 is similarly oriented relative to the frame such that the working surface 16 thereof is elongate in a longitudinal direction which is inclined downwardly from the top end to the bottom end thereof so as to be parallel to the lower press block therebelow throughout the range of movement of the upper press block between the open position and the working position.

The carrier body spans the full length of the press block in the longitudinal direction and includes a pair of opposed end flanges 28 which are generally coplanar at opposing ends of the press block such that the opposed outer edges thereof are slidably received within corresponding channels within the guides 26 which slidably receive the end flanges of the carrier body therein to guide the sliding movement thereof in the working direction.

The working surface of the upper press block has a cross sectional shape which tapers to an apex which spans along a length of the working surface in the longitudinal direction and which is positioned for alignment centrally spaced between the two edges of the working surface of the lower press block such that displacement of the press blocks towards one another in the working position causes the apex to be received between the two opposed edges of the lower press block to cause a blank metal sheet received therebetween to be bent into two flanges oriented generally perpendicularly to one another.

A lever 30 is pivotally supported on the frame at one end of a pivot shaft 32 which spans perpendicularly to the two side walls 20 across the space between the side walls to be pivotally supported at opposing ends within respective bearings supported on the side walls. The lever 30 is fixed onto one end of the pivot shaft 32 protruding outwardly beyond the respective side wall of the frame to support the lever externally of the frame. The lever 30 can be releaseably mounted on the pivot shaft and the pivot shaft 32 can in turn be reversibly mounted between the two side walls such that the lever 30 can be mounted externally adjacent either one of the two side walls in a reversible orientation as may be desired.

A linkage is provided for coupling the lever to the upper press block in the form of a crank arm 34 fixed onto the pivot shaft centrally between the two side walls of the frame to extend radially outward therefrom to an outer end of the crank arm 34 which is pivotally coupled to the carrier body of the upper press block at a central position thereon in the longitudinal direction between the two opposed ends of the press block. The lever is thus pivotal together with the pivot shaft 32 about a horizontal pivot axis of the shaft relative to the frame. The lever initially extends generally upward in the open position and is pivoted from the open position over a central intermediate position in which the center of mass is directly above the pivot axis towards the working position in which the lever extends downwardly and forwardly towards the bottom ends of the press blocks.

The lever includes an inner portion 36 which extends radially outward from the pivot shaft 32 and an outer portion 38 which spans the majority of the length of the lever in the radial direction from the outer end of the inner portion 36. The outer portion 38 is angularly offset from the inner portion into the direction of rotation of the lever from the open position towards the working position. Accordingly by positioning the outer portion 38 to extend generally vertically upward, the outer portion is resultingly offset rearwardly towards the top end of the press blocks in relation to the pivot axis in the open position so that the weight of the lever acts in a direction which maintains the lever away from the working position in the open position. Displacing the press blocks towards the working position thus requires the center of mass of the lever to be rotated upwardly and forwardly prior to being rotated downwardly and forwardly towards the downward inclination of the lever towards the bottom end of the press blocks in the working position.

Each of the two side walls of the frame includes a side opening 40 formed therein in the form of an elongate slot in alignment with the space between the working surfaces of the two press blocks in the open position. The side openings span the full length of the working surfaces in the longitudinal direction thereof. The two side openings 40 are open through to a bottom end of the frame defining a bottom opening 42 of the frame in alignment between the working surfaces of the upper and lower press blocks through which a formed step flashing is arranged to be released from the frame between the bottom ends of the upper and lower press blocks when the press blocks are displaced back into the open position.

To assist in positioning a blank metal sheet spanning in a lateral direction through the two side openings 40 between the working surfaces of the press blocks prior to bending, there is provided a depth guide in the form of an end wall 44 arranged to be supported on one of the side walls of the frame parallel thereto at a location spaced laterally outward therefrom in the direction of the pivot axis of the lever.

The end wall 44 is supported by a pair of mounting rods 46 spanning between the side walls of the frame and the end wall parallel to the pivot axis. The rods comprise threaded members received through cooperating apertures in the end wall with suitable threaded retainers being fastened about the rods 46 to retain the position of the end wall at any one of a plurality of adjustable spacings from the side wall. The end wall 44 is in alignment with the two side openings in the frame such that a blank metal sheet which is inserted through the side openings to span in the lateral direction through the frame between the working surfaces of the press blocks resultantly abuts the end wall along one side edge of the blank metal sheet. The end wall can be adjusted so that when the blank metal sheet abuts the end wall, a desired lateral center of the sheet where the folds between the two flanges of the step flashing is to be defined is in alignment with the apex of the upper press block.

The frame 18 further comprises a trough portion 48 extending downwardly and forwardly outwardly from the bottom end of the main portion locating the mounting blocks therebetween. The trough portion also comprises two side walls 50 which are integral and coplanar with the corresponding side walls 20 of the main portion so as to be similarly parallel and spaced apart from one another. Suitable frame member spacers 22 are again provided spanning between the two side walls 52 maintain the space therebetween.

The trough portion 48 of the frame is shaped such that the top edges of the two side walls 50 are oriented parallel to the longitudinal direction of the working surfaces of the press blocks spaced therebelow by a thickness corresponding to several layers of the formed step flashings stacked one above the other.

Each of the top edges of the side walls 50 comprises a pair of flanges 52 formed integrally therewith which extend upwardly from the top edge at an outward angle away from the opposing side wall so that the flanges 52 on the two opposed side walls are generally in a V-shaped orientation relative to one another in alignment with the bottom opening of the main portion of the frame to receive step flashing cradled therein.

A stop member 54 is coupled between the two side walls adjacent the bottom end thereof and projects outwardly from space between the two side walls to form an end wall against which the bottom ends of the step flashings being formed are abutted when the step flashings are slidably removed through the bottom end of the main portion of the frame. The stop member 54 is spaced from the bottom end of the main portion of the frame by a spacing which is greater than the length of the working surfaces of the press blocks for accommodating the length of the step flashing being formed. An upper surface of the stop member is perpendicular to the longitudinal direction of the working surfaces of the press blocks to abut the ends of the step flashings being formed.

The bottom end of the side walls 20 of the main portion of the frame comprises a plurality of horizontal mounting flanges spanning laterally outwardly from opposing sides of the frame and locating suitable mounting apertures therein to permit fastening of the frame in fixed relation to a horizontal supporting surface. The inner rear edge of the side walls forming the trough portion 48 of the frame further comprise vertical mounting flanges 58 which also span laterally outward from opposing side walls of the frame in a generally common vertical plane with mounting apertures being provided therein to receive suitable fasteners therethrough for fastening in fixed relation to an upright supporting surface. In this manner the frame is arranged for suitable fixed mounting to respective top and front sides of a suitable bench or counter for example.

A counting mechanism 60 is mounted on the frame between the side walls 20 adjacent the top end thereof so as to be spaced above the press blocks. The counter includes a suitable sensor 62 mounted in proximity to the lever to detect movement of the lever between the open and working positions. In this manner the counter is arranged to detect and record each displacement of the lever between the open position and the working position and back to the open position. In this method the counter counts how many blank metal sheets are bent into step flashings and resultantly stacked within a trough portion of the frame.

In use the frame is initially mounted in fixed position onto a suitable supporting surface. The user inserts a blank metal sheet through the side opening 40 in a respective one of the side walls 20 opposite the end wall 44 until the blank metal sheet is fully received through the housing and abuts the end wall 44 along the opposing edge thereof. The distance of the end wall 44 is initially set to a selected space from the nearest side wall of the frame which is proportional to the desired width of step flashing to be formed.

The user then displaces the lever from the open position to the working position to cause the upper press block to be displaced in a linear sliding movement relative to the frame towards the lower press block to bend the blank metal sheet into a step flashing comprising two perpendicular flanges as described above. Typically the spacing of the end wall from the frame is selected such that the end wall position corresponds to the desired size of step flashing being formed. The lever is displaced over center towards the working position and then back over center upon return to the open position such that releasing the lever causes the lever to remain in the open position.

Once the press blocks begin to apply pressure to a blank metal sheet to bend the sheet into step flashing, the user can release the step flashing and reach for another blank metal sheet as the force applied between the upper and lower press blocks onto the blank metal sheet being bent is sufficient to retain the sheet between the press blocks until bent into step flashing. Upon release of the lever back towards the open position, the release of pressure will thus cause the formed step flashing to automatically slide out the bottom end of the frame between the working surfaces of the press blocks under force of gravity by nature of the frame and side openings therein being open to the bottom end of the main portion and the inclination of the working surfaces.

The alignment of the trough with the open bottom end of the main portion of the frame results in the formed step flashing being cradled within the trough portion with a sufficient downward offset of the trough portion relative to the longitudinal direction of the working surfaces that several step flashings can be formed and stacked one upon the other with each being automatically dropped on top of the previous one within the trough portion.

The user continues to reach for additional blank metal sheets and insert them through the frame as each prior sheet is bent into step flashing and released into the trough portion until the counter indicates that the desired number of step flashings have been formed. The orientation of the stop member to form and end wall perpendicular to the longitudinal direction of sliding removal of the step flashing from the frame causes the bottom ends of the formed step flashings to be abutted thereon and stacked for removal of a plurality of formed step flashings together with one another as a formed stack.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A step flashing bending device for bending blank metal sheets into step flashing, the device comprising:

a frame;

a lower press block comprising an elongate working surface supported on the frame to extend in a longitudinal direction at a downward inclination from a top end to a bottom end of the lower press block; and an upper press block comprising an elongate working surface supported on the frame to extend in a longitudinal direction at a downward inclination from a top end to a bottom end of the upper press block so as to be substantially parallel to the working surface of the lower press block;

the upper and lower press blocks being supported on the frame for movement relative to one another between an open position in which the working surfaces are spaced apart from one another so as to receive a blank metal sheet therebetween and a working position in which the working surfaces are displaced towards one another relative to the open position;

the working surfaces being suitably shaped such that the blank metal sheet is arranged to be bent into a step flashing in the working position; and the frame comprising a bottom opening between working surfaces of the upper and lower press blocks at the bottom ends thereof such that the working surfaces are arranged to release the step flashing from the frame between the bottom ends of the upper and lower press blocks when the press blocks are displaced into the open position.

2. The device according to claim 1 wherein the lower press block is supported in fixed relation to the frame.

3. The device according to claim 1 wherein the upper press block is supported at the top and bottom ends on the frame for linear sliding movement relative to the frame in a working direction perpendicular to the longitudinal direction of the working surfaces between the open position and the working position and wherein there is provided a lever pivotally coupled on the frame, the lever being connected through a linkage to the upper press block at a central location between the top and bottom ends of the working surface.

4. The device according to claim 1 wherein the frame comprises a pair of side walls supporting the press blocks therebetween and wherein there is provided a side opening in each side wall in alignment with the space between the working surfaces in the open position so as to be arranged to receive opposing ends of the blank metal sheets therethrough.

5. The device according to claim 4 wherein the side openings are open at respective bottom ends thereof such that the step flashing is arranged to be released from the side openings in the frame through the bottom ends of the side openings.

6. The device according to claim 4 wherein there is provided an end wall spanning generally parallel to a plane of one of the side openings of the side walls at a location spaced laterally outwardly from the respective side wall so as to be arranged to abut one side edge of a blank metal sheet inserted between the working surfaces for bending into step flashing.

7. The device according to claim 6 wherein the end wall is supported on the frame such that a space between the end wall and the respective side wall is adjustable.

8. The device according to claim 1 wherein the frame comprises a pair of side walls supporting the press blocks therebetween and wherein there is provided a lever pivotally coupled on one of the side walls of the frame and a linkage coupled between the lever and at least one of the press blocks to displace the press blocks into the working position when the lever is pivoted.

9. The device according to claim 8 wherein a pivot shaft pivotally supported at opposing ends on the two side walls of the frame and wherein the lever is arranged to be mounted on the pivot shaft so as to be reversibly mounted adjacent either one of the two side walls of the frame.

10. The device according to claim 8 wherein the lever is rotated upwardly over center between the open position and the working position of the press blocks.

11. The device according to claim 10 wherein the lever comprises an inner portion adjacent a pivot axis of the lever which extends radially outwardly from the pivot axis and an outer portion which extends outwardly from the inner portion and which is angularly offset from the inner portion in a direction of rotation of the lever from the open position to the working position.

12. The device according to claim 1 wherein there is provided a counter mechanism supported on the frame and arranged to count each movement of the upper and lower press blocks between the open and working positions.

13. The device according to claim 1 wherein the frame includes at least one horizontal mounting flange arranged to be fastened to a generally horizontal supporting surface.

14. The device according to claim 1 wherein the frame includes at least one vertical mounting flange arranged to be fastened to a generally vertical supporting surface.

15. The device according to claim 1 wherein the frame includes a trough portion arranged to support a plurality of stacked step flashings therein, the trough portion being aligned with the bottom opening in the frame so as to be arranged to receive step flashing which is slidably removed from the press blocks in the longitudinal direction of the working surfaces.

* * * * *